US006076220A

United States Patent [19]

Petner

[11] Patent Number: 6,076,220

[45] Date of Patent: Jun. 20, 2000

[54] MOP ROLLER WRINGER LOCKING SYSTEM

[75] Inventor: Robert E. Petner, Burlington, N.J.

[73] Assignee: Quickie Manufacturing Company, Cinnaminson, N.J.

[21] Appl. No.: 09/208,863

[22] Filed: Dec. 10, 1998

[51] Int. Cl.[7] ..... A47L 13/144

[52] U.S. Cl. ..... 15/119.1

[58] Field of Search ..... 15/116.1, 116.2, 15/119.1, 119.2, 120.1, 120.2

[56] References Cited

U.S. PATENT DOCUMENTS

| | | | |
|---|---|---|---|
| 2,820,232 | 1/1958 | Vosbikian | 15/119.1 |
| 3,074,091 | 1/1963 | Vosbikian et al. | 15/119.1 |
| 3,084,365 | 4/1963 | Vosbikian et al. | 15/119.1 |
| 3,089,171 | 5/1963 | Vosbikian | 15/119.1 |
| 4,164,800 | 8/1979 | Strahs | 15/119.1 |
| 4,324,016 | 4/1982 | Herbig | 15/119.1 |
| 4,809,387 | 3/1989 | Nakamura | 15/119.1 |
| 5,675,857 | 10/1997 | Hirse | 15/119.1 |
| 5,724,694 | 3/1998 | Lewis | 15/119.1 |
| 5,894,625 | 4/1999 | Vosbikian | 15/119.1 |

*Primary Examiner*—Gary K. Graham

*Attorney, Agent, or Firm*—Stuart M. Goldstein

[57] ABSTRACT

A locking system is employed to automatically secure the roller wringer of a mop in a locked, stored position on the mop. The mop itself has a cleaning head consisting of a plurality of fluid absorbent material strands connected to a handle. A wringer rod is connected at one end to a slideable, manually operated sleeve located around the handle. The rod is pivotally connected at its other end to the roller wringer which is of ringed or closed polygon configuration, taking its shape from a flexibly biased support member. As the sleeve is manually pushed down the handle, the roller wringer is forced over the mop head strands, causing the support member and rollers to expand around the strands. When the roller wringer has reached the end of the mop head strands, it pivots up. Manual movement of the sleeve back up the handle towards the user draws the roller wringer over the mop head and back to the lower end of the handle. The locking system consists of a wringer shroud and a stop piece which is connected to the roller wringer and pivotally connected to the wringer rod. As the wringer rod is withdrawn towards the user, the stop piece contacts the edge of the shroud, causing the wringer to pivot towards the handle and through an opening in the support member, repositioning the wringer around the handle and within the shroud.

13 Claims, 4 Drawing Sheets

MOP ROLLER WRINGER LOCKING SYSTEM

BACKGROUND OF THE INVENTION

Mops have long been used as effective tools for a variety of cleaning applications. Their use for cleaning floor surfaces and for mopping and absorbing liquid from surfaces is well known. One such common mop consists of a cleaning head with a plurality of strands made of cotton, cloth, sponge-plastic, or other fluid absorbent material. An elongated handle is normally attached to one end of the cleaning head.

Mops of this type work very well when their cleaning head strands are dry. However, the mop becomes ineffective when the strands become saturated with fluid. To remedy this problem, various mops with wringer devices have evolved with features which cause the strands to be wrung out, compressed, and squeezed of fluid. For instance, U.S. Pat. No. 5,675,857 employs the use of a sleeve to wring out moisture from a mop's cleaning head. U.S. Pat. Nos. 5,724,694 and 4,809,387, disclose sleeves in combination with rollers. U.S. Pat. No. 2,820,232 simply shows the use of rollers to squeeze wet mop strand elements. These prior devices, however, have a number of disadvantages. For instance, the wringers used on these mops have either cumbersome sleeve arrangements or are highly mechanized devices. Significantly they are inefficient for the purposes for which they were designed. Many of the devices do not provide sufficient uniform pressure to the mop head strands to wring a substantial amount of the moisture from the mop head.

U. S. Pat. Nos. 3,089,171, and 4,164,800 employ a solid annular ring attached to a support rod to apply pressure completely around the mop head. But since the ring is rigid, it also does not apply enough compressive force to fully wring dry the strands of the head. Further, the internal surfaces of the ring offer substantial resistence as the ring travels down the strands of the mop head. This makes it more difficult to move the ring all the way to the end of the mop head. In addition, the flapper on the bottom of the ring, designed to allow repositioning of the ring over the mop handle when it is pulled toward the user, is inefficient and prone to dysfunction and breakage, upon extended use.

Co-pending U.S. application Ser. No. 09/085,605, U.S. Pat. No. 5,894,625, solves the shortcomings of the prior art; however, no prior roller wringer mop addresses the problem of ensuring that the actual roller wringer, after it has wrung the mop strands and is withdrawn toward the user for storage, is automatically repositioned on the handle to allow unencumbered mopping. Prior mop roller wringers are not reliable in repositioning the wringers without manual intervention by the user. The locking system contemplated herein is an improvement over prior mop roller wringers, including co-pending application Ser. No. 09/085,605, on which it is anticipated this system can be used.

SUMMARY OF THE INVENTION

It is thus the object of the present invention to overcome the limitations and disadvantages of prior hand mop ringing devices.

It is another object of the present invention to provide a roller wringer and locking system for a hand mop with a plurality of strands of fluid absorbent material which is easy and simple to use.

It is still another object of the present invention to provide a roller wringer and locking system for a hand mop which efficiently, easily, and fully wrings moisture from the mop and automatically returns the wringer to a position which allows unencumbered reuse of the wringer.

It is a further object of the present invention to provide a roller wringer and locking system for a hand mop which uses biased rollers to compress and wring moisture from the mop strands to their full extent with little resistance and hence less difficulty and then automatically returns the wringer to a housed position over and around the handle of the mop.

It is still a further object of the present invention to provide a roller wringer and locking system for a hand mop which can quickly and easily be pulled toward the user and be automatically repositioned over and around the mop handle in a housed position after the wringing operation is completed, regardless of the position of the mop in relation to the cleaning surface.

The present invention comprises a locking system which is employed to automatically secure the roller wringer of a mop in a locked, stored position on the mop. The mop itself has a cleaning head consisting of a plurality of fluid absorbent material strands connected to a handle. A wringer rod is connected at one end to a slideable, manually operated sleeve located around the handle. The rod is pivotally connected at its other end to the roller wringer which is of ringed or closed polygon configuration, taking its shape from a flexibly biased support member. The support member passes through roller elements positioned one on each of the sides of the member and completely surrounding it. As the sleeve is manually pushed down the handle, the roller wringer is forced over the mop head strands, causing the support member and rollers to expand around the strands. The biased nature of the support member ultimately causes the rollers to compress the strands, squeezing the strands and moisture from them. When the roller wringer has reached the end of the mop head strands, it pivots up. Manual movement of the sleeve back up the handle towards the user draws the roller wringer over the mop head and back to the lower end of the handle. The locking system of the present invention consists of a wringer shroud and a stop piece which is connected to the roller wringer and pivotally connected to the wringer rod. As the wringer rod is withdrawn towards the user, the stop piece contacts the edge of the shroud, causing the wringer to pivot towards the handle and through an opening in the support member, repositioning the wringer around the handle and within the shroud.

The novel features which are considered as characteristic of the invention are set forth in particular in the appended claims. The sponge mop roller wringer itself, however, both as to its design, construction, and use, together with additional features and advantages thereof, are best understood upon review of the following detailed description with reference to the accompanying drawings.

DETAILED DESCRIPTION OF THE INVENTION

Figure 1:
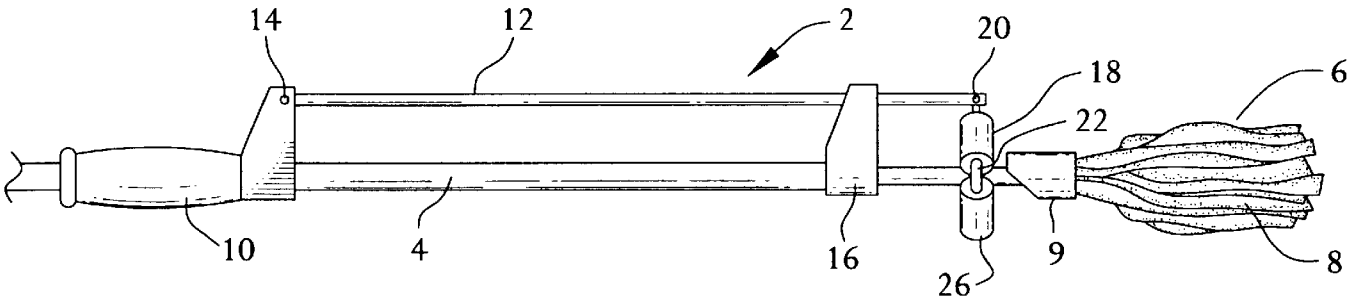
FIG. 1 is an elevation view of the mop without the roller wringer locking system of the present invention, showing the roller wringer in position around the handle during the mop's use mode.

Mop 2 comprises handle 4 and mop head 6. Mop head 6 has a plurality of absorbent material strands 8 for mopping, cleaning, moisture absorbency, and similar functions. Spreader 9 is located at the end of handle 4, near strands 8. Sleeve 10 is configured to surround handle 4, and is manually slideable up and down the handle. Wringer rod 12 is connected to sleeve 10 at connection point 14. Rod 12 is guided for slideable movement over and along handle 4 by rod support 16. Roller wringer 18 is pivotally connected to rod 12 at point 20. As shown in FIGS. 1–4, mop 2 does not disclose the roller wringer locking system of the present invention. However, it is disclosed to show the mechanism of the basic roller wringer operation used with the invention.

Figure 5:
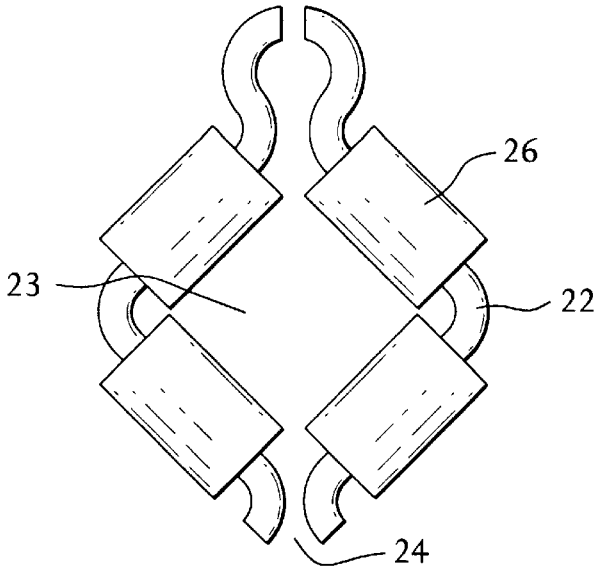
FIG. 5 is an end view of the roller wringer of the preferred embodiment of the invention.
Figure 6:
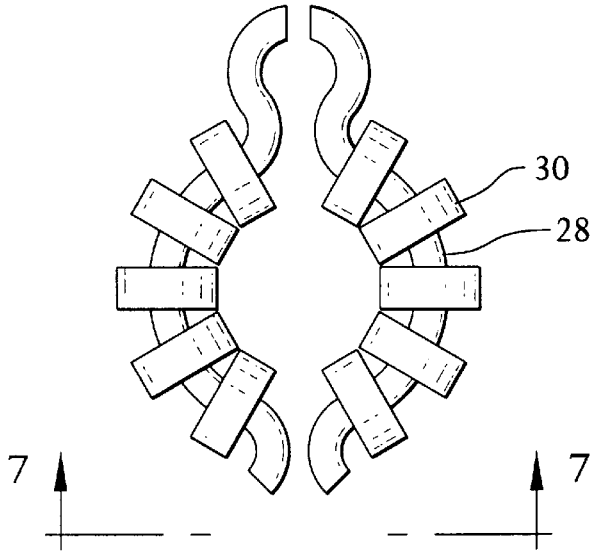
FIG. 6 is an end view of another embodiment of the invention.
Figure 7:
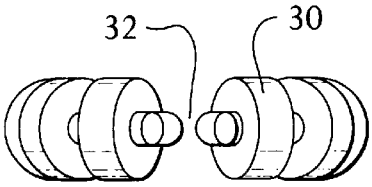
FIG. 7 is a side view of the embodiment in FIG. 6.

Roller wringer 18 is comprised of a closed polygonal shaped rod support member 22, with center opening 23. While support member 22 provides a measure of rigidity, it is made of a material which allows it flexibility and resiliency or bias. A slight bottom opening 24 is located at the bottom of support member 22. Bottom opening 24 can be resiliently expanded to allow handle 4 to be positioned through the opening and within center opening 23 of roller wringer 18. The resiliently biased nature of support member 22 allows for the expansion of opening 24. Support member 22 in FIG. 5 is shown as being rectangular. However it can be formed as any geometric, polygonal shape with multiple sites, including a triangle or even an annular ring, such as is shown in FIGS. 6 and 7. The roller wringer in this embodiment uses an annular support member 28 rollers 30 and bottom opening 32.

Support member 22, in the embodiment shown in FIGS. 1–5, passes through a plurality of roller elements 26. In the preferred embodiment, one roller element 26 is positioned around each of the sides of support member 22, so that the roller elements extend substantially around the entire perimeter of the support member.

Figure 2:
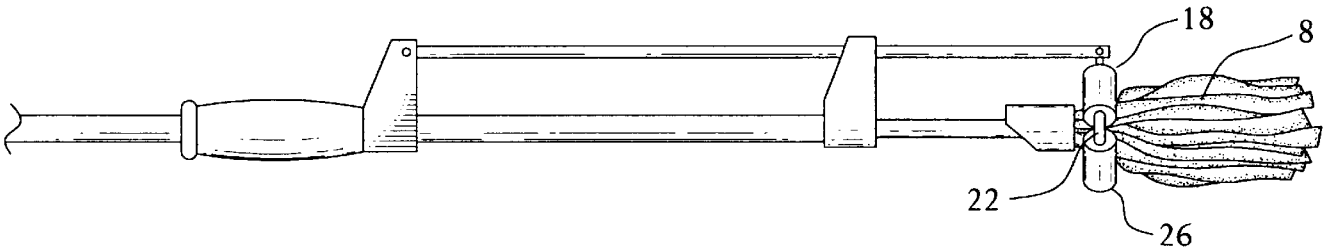
FIG. 2 is an elevation view of the mop without the roller wringer locking system of the present invention, showing the roller wringer around the upper section of the mop head, as it begins its path over the head.

Roller wringer 18, as shown in FIG. 1, is in position surrounding handle 4 to allow mop 2 to be used for cleaning, mopping, etc. In order to wring moisture out of strands 8 of mop 2, sleeve 10 is pushed down handle 4. This causes rod 12 to move roller wringer 18 towards spreader 9, where rollers 26 are caused to expand slightly outward. As roller wringer 18 is moved toward mop head 6, it contacts strands 8, as shown in FIG. 2, where biased support member 22 allows rollers 26 to expand over the strands, while still maintaining the rigidity and shape of the wringer.

Figure 3:
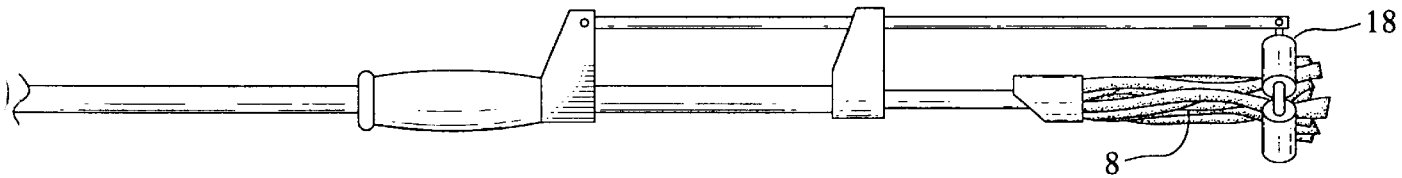
FIG. 3 is an elevation view of the mop without the roller wringer locking system of the present invention, showing the roller wringer near the end of the mop head.
Figure 4:
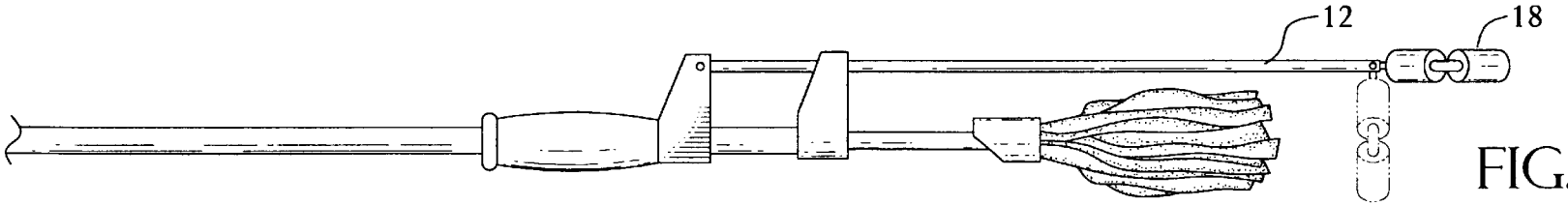
FIG. 4 is an elevation view of the mop without the roller wringer locking system of the present invention, showing the roller wringer free of the mop head, pivoted up just prior to it being withdrawn toward the handle to return to the position shown in FIG. 1.

As sleeve 10 continues to move roller wringer 18 down over mop strands 8, rollers 26 continue to expand and compress the strands. As a result of the bias nature of support member 22, rollers 26 apply a compressive, squeezing force, uniformly around the strands. When roller wringer 18 has reached the end of mop head 6 as shown in FIG. 3, all strands 8 have been uniformally squeezed of moisture. As shown in FIG. 4, when the wringer comes off strands 8, it pivots up on wringer rod 12.

Manual movement of sleeve 10 back up handle 4 in the direction of the user draws rod 12 and hence roller wringer 18 back towards the end of the handle. When over handle 4, roller wringer 18 pivots down toward the handle. Opening 24 allows roller wringer 18 to be repositioned so that it surrounds handle 4, with the handle through center opening 23, as in FIG. 1. Roller wringer 18 is now ready to be used after the mopping process again saturates strands 8.

The roller wringer locking system of the present invention is shown in FIGS. 8–11. The locking system consists of shroud 34, with the outside edge 36. Internal locking tabs 35 protrude from the inside walls of shroud 34. Shroud 34 is secured, by conventional means, to handle 4 at 38. Shroud 34 encloses rod support 35. Wringer rod 12 traverses through shroud 34. Roller wringer 18 is attached to stop piece 42, which has laterally extending surfaces 44. Stop piece 42 is pivotally attached to wringer rod 12 at 46.

Figure 8:
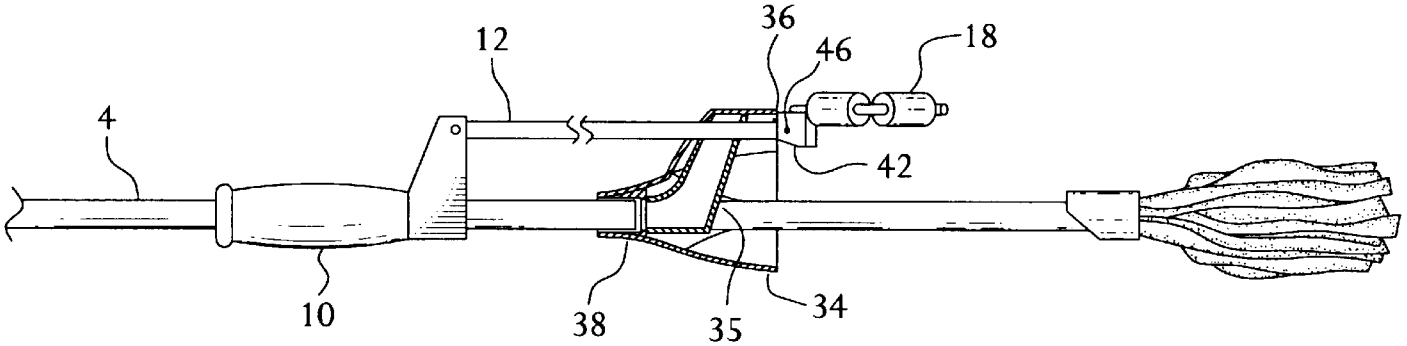
FIG. 8 is an elevation view of the mop with the roller wringer locking system, as the roller wringer is withdrawn towards the user by means of the wringer rod and with its stop piece contacting the shroud.
Figure 9:
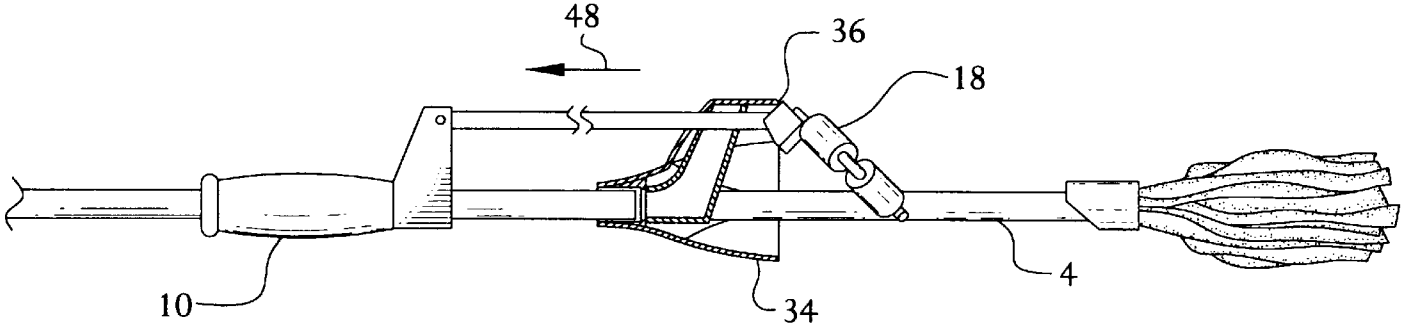
FIG. 9 is an elevation view of the mop in FIG. 8 showing the roller wringer pivoting towards the handle as the wringer rod is drawn further towards the user.
Figure 10:
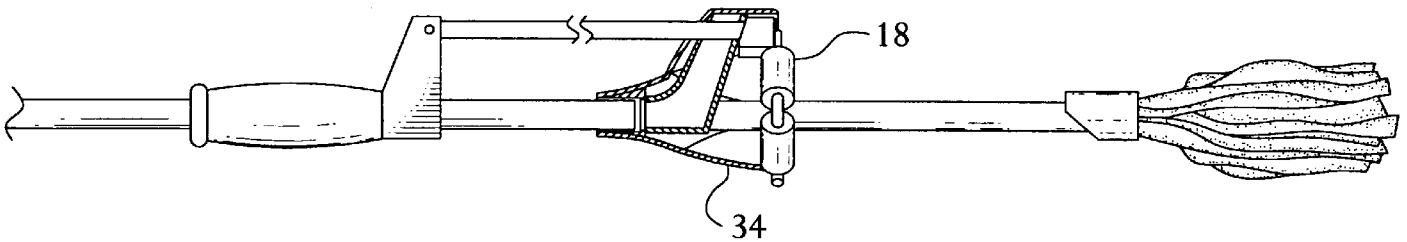
FIG. 10 is an elevation view of the mop in FIG. 9 showing the roller wringer fully pivoted around the handle and secured within the shroud.
Figure 11:
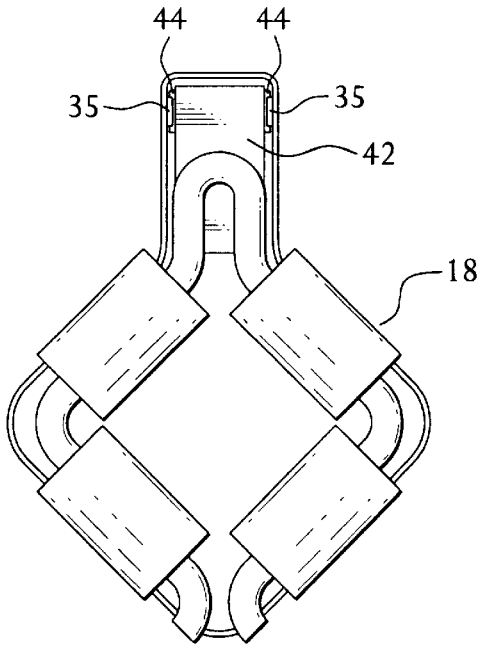
FIG. 11 is a perspective view of the shroud and its locking tabs.
Figure 12:
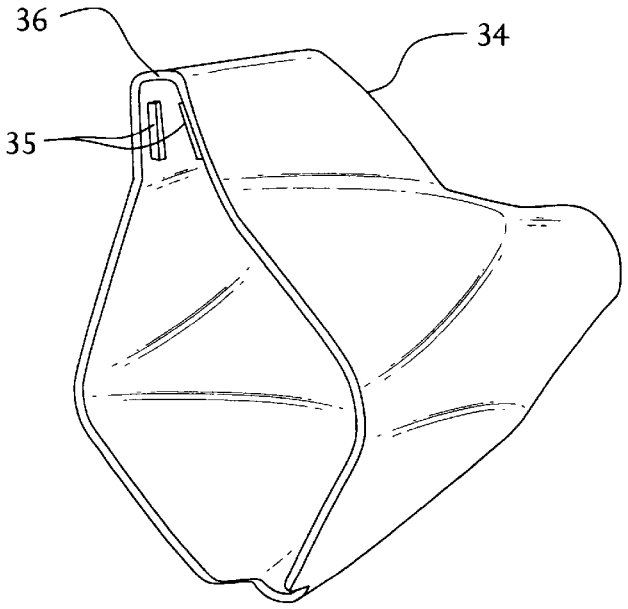

FIG. 8 shows roller wringer 18, withdrawn in the direction of the user 48, by movement of sleeve 10 and hence wringer rod 12, such that stop piece 42 contacts edge 36 of shroud 34. Continued movement of sleeve 10 towards the direction of the user 48, causes stop piece 42 and hence roller wringer 18 to pivot towards and in the direction of handle 4, as shown in FIG. 9. As sleeve 10 continues being moved in the user's direction 48, roller wringer 18 pivots to a housed position within shroud 34, where it can be appreciated that laterally extending surfaces 44 of stop piece 42 come in contact with and are pushed passed the resistance offered by locking tabs 35 of shroud 34, thus securing roller wringer 18 within the shroud, as seen in FIG. 10.

When roller wringer 18 is again needed to wring moisture from strands 8, sleeve 10 is moved away from the user, in the direction opposite to 48. It can be appreciated that sufficient pushing force exerted on sleeve 10, through wringer rod 12, will cause surfaces 44 of stop piece 42 to overcome the restraining force of tabs 35, allowing roller wringer 18 to freely move towards the end of the mop to once again apply compressive, wringer forces to strands 8.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed:

1. A mop comprising;

(a) a handle;

(b) a plurality of fluid absorbent material mopping elements secured at one end of the handle;

(c) a wringer rod connected to the handle, said wringer rod being moveable along the handle, towards and away from the mopping elements;

(d) stop means pivotally connected to the wringer rod;

(e) contact means secured in stationary position on the handle; and (f) wringer means for applying compressive force to the mopping elements, said wringer means being connected to the stop means, whereby continued movement of the wringer rod along the handle in a direction away from the mopping elements causes the stop means to impact the contact means and automatically pivot the wringer means in the direction of the handle.

2. A mop as described in claim 1 in which the stop means is a block piece.

3. A mop as described in claim 2 in which the contact means comprises a shroud secured to the handle.

4. A mop as described in claim 1 in which the contact means comprises a shroud secured to the handle.

5. A mop is described in claim 1 further comprising locking means to secure the wringer means in a position around the handle.

6. A mop as described in claim 5 in which the locking means is located in the contact means.

7. A mop as described in claim 6 in which the contact means comprises a shroud secured to the handle.

8. A mop as in claim 7 in which the locking means comprises dual tabs within the shroud.

9. A mop is described in claim 6 in which the locking means comprises dual tabs.

10. A mop as in claim 1 in which the wringer means comprises an opening means to allow movement of the wringer means over and around the mop handle when the wringer means is pivoted in the direction of the handle.

11. A mop as in claim 1 in which when the stop means impacts the contact means the wringer means pivots to a position over and around the handle and in which the contact means comprises a space to house the wringer means when the wringer means is pivoted to said position.

12. A mop as in claim 11 in which the contact means comprises a shroud secured to the handle.

13. A mop as in claim 11 further comprising locking means to secure the wringer means in said position.

* * * * *